US007140165B2

(12) United States Patent
Ventura et al.

(10) Patent No.: US 7,140,165 B2
(45) Date of Patent: Nov. 28, 2006

(54) APPARATUS AND METHOD FOR SEALING BOXES

(75) Inventors: Leon P. Ventura, Watsonville, CA (US); Albarran Serafin, Salinas, CA (US)

(73) Assignee: Dole Food Company, Inc., Westlake Village, CA (US)

( * ) Notice: Subject to any disclaimer, the term of this patent is extended or adjusted under 35 U.S.C. 154(b) by 0 days.

(21) Appl. No.: 09/999,555

(22) Filed: Nov. 30, 2001

(65) Prior Publication Data

US 2003/0101688 A1 Jun. 5, 2003

(51) Int. Cl.
*B65B 7/20* (2006.01)
*B65B 61/00* (2006.01)

(52) U.S. Cl. ..... 53/415; 53/491; 53/377.2; 493/476

(58) Field of Classification Search ..... 53/75, 53/136.4, 415, 117, 504, 377.2, 378.3, 491; 493/476

See application file for complete search history.

(56) References Cited

U.S. PATENT DOCUMENTS 3,045,402 A * 7/1962 Keely et al. ..... 53/75
3,546,839 A * 12/1970 Comstock ..... 53/508
3,626,660 A * 12/1971 Dortmann ..... 53/558
3,775,937 A * 12/1973 Devan et al. ..... 53/75
3,808,958 A * 5/1974 Keener et al. ..... 493/277
3,894,380 A * 7/1975 Poulsen ..... 53/75
4,044,527 A * 8/1977 Ulrich et al. ..... 53/136.4
4,161,138 A * 7/1979 Marchetti ..... 493/117
4,262,469 A * 4/1981 Ooms et al. ..... 53/76
4,317,319 A * 3/1982 Price ..... 53/76
4,541,888 A * 9/1985 Marchetti ..... 156/468
4,545,175 A * 10/1985 Beckett ..... 53/69
4,554,042 A * 11/1985 Marchetti ..... 156/350
4,585,504 A * 4/1986 Marchetti ..... 156/351
4,722,165 A * 2/1988 Marchetti ..... 53/76
4,955,177 A * 9/1990 Lerner et al. ..... 53/136.4
4,972,654 A * 11/1990 Marchetti ..... 53/76
5,323,586 A * 6/1994 Lissoni et al. ..... 53/136.4
5,685,814 A * 11/1997 Le ..... 493/117
5,916,106 A * 6/1999 Chen ..... 53/136.4

* cited by examiner

*Primary Examiner*—John Sipos
(74) *Attorney, Agent, or Firm*—Morrison & Foerster LLP

(57) ABSTRACT

An apparatus for sealing a box having four top flaps initially disposed in an open position. The apparatus includes a conveying system for conveying the box from a first end of the apparatus to a second end of the apparatus. The apparatus also includes a flap folding system for folding the top flaps of the box into folded and horizontal positions as the box is conveyed from a first end of the apparatus to a second end of the apparatus. The flap folding system has a first flap folding member configured to fold a fourth top flap of the box, a second flap folding member configured to fold a second top flap of the box, and a pair of oppositely disposed side flap folding members configured to fold a first and third top flaps of the box so as to abut each other. A tape dispensing system is configured to dispense tape across at least a portion of the third and fourth top flaps of the box in order to maintain the third and fourth top flaps in abutment with each other, thereby sealing the box.

30 Claims, 7 Drawing Sheets

APPARATUS AND METHOD FOR SEALING BOXES

FIELD OF THE INVENTION

The present invention relates generally to boxes, and more specifically, in accordance with one example embodiment, to an apparatus and method for sealing boxes.

BACKGROUND OF THE INVENTION

There are countless ways to package products. One such way is the use of a box, an example of which is shown in FIG. 1. The box 10 shown in FIG. 1 is made of a single sheet of cardboard or similar material which is cut and folded in order to maintain the shape of a rectangular box, as is well-known in the art. Specifically, the box 10 has a first side 14*a*, a second side 14*b*, a third side 14*c* and a fourth side 14*d*, each of which is successively coupled to and folded perpendicular to its neighboring sides. In addition, the box 10 has a strip 14*e* which extends from fourth side 14*d* and which overlaps and is fastened to the first side 14*a*.

A bottom 12 of the box 10 is formed from first bottom flap 12*a*, second bottom flap 12*b*, third bottom flap 12*c* and fourth bottom flap 12*d*. Typically, the second bottom flap 12*b* and the fourth bottom flap 12*d* and folded toward each other until they are positioned perpendicular to the sides 14. Then, the first bottom flap 12*a* and the third bottom flap 12*c* are likewise folded toward each other until they also are positioned perpendicular to the sides 14. The first bottom flap 12*a* and the third bottom flap 12*c* are usually sized so that the edge 12*e* of the first bottom flap 12*a* abuts the edge 12*f* of the third bottom flap 12*c*. In order to maintain the edge 12*e* of the first bottom flap 12*a* in abutment with the edge 12*f* of the third bottom flap 12*c*, the edges 12*e* and 12*f* are typically stapled together. More specifically, a plurality of staples are employed along the lengths of the edges 12*e* and 12*f*, such that a first prong of each staple penetrates and fastens the edge 12*e* of the first bottom flap 12*a*, and a second prong of each staple penetrates and fastens the edge 12*f* of the third bottom flap 12*c*.

Once the bottom of the box 10 has been fastened, the box 10 can be filled with any conceivable type of product. Once filled, the box 10 can then be closed and sealed. In order to seal the box, a top 16 of the box 10 is formed from a first top flap 16*a*, a second top flap 16*b*, a third top flap 16*c* and a fourth top flap 16*d*. Typically, the second top flap 16*b* and the fourth top flap 16*d* are folded toward each other until they are positioned perpendicular to the sides 14. Then, the first top flap 16*a* and the third top flap 16*c* are likewise folded toward each other until they also are positioned perpendicular to the sides 14. Again, the first top flap 16*a* and the third top flap 16*c* are usually sized so that the edge 16*e* of the first top flap 16*a* abuts the edge 16*f* of the third top flap 16*c*. In order to maintain the edge 16*e* of the first top flap 16*a* in abutment with the edge 16*f* of the third top flap 16*c*, the edges 16*e* and 16*f* are typically stapled together, whereby a plurality of staples are employed along the lengths of the edges 16*e* and 16*f*, such that a first prong of each staple penetrates and fastens the edge 16*e* of the first bottom flap 16*a*, and a second prong of each staple penetrates and fastens the edge 16*f* of the third bottom flap 16*c*.

The conventionally employed method for sealing boxes, as described above, is labor-intensive in that the staples must be individually applied. In addition, this method is ineffective in that the boxes are inadequately sealed, e.g., there is space along the edges 16*e* and 16*f* in between the staples through which products may leak out of or escape from the box, or through which other substances may leak into or enter the box. Furthermore, the method is unsafe, in that the prongs of the staples may injure persons that are applying the staples to seal the box or persons that are opening the box. Also, the method is unsanitary. For instance, the staples that are employed may inadvertently puncture the products, such as food, inside the box. In addition, if the product or products in the box is food wrapped in individual packaging, the puncturing of the packaging may cause the food to spoil, creating health risks to consumers and causing economic loss to the producer of the food. In addition, the staples may oxidize or rust and thereby contaminate the food in the box, creating additional health problems and economic losses.

Thus, there is a need for an improved method and apparatus for sealing boxes.

SUMMARY OF THE INVENTION

One example embodiment of the present invention relates to an apparatus for sealing a box that has four top flaps initially disposed in an open position. The apparatus includes a conveying system for conveying the box from a first end of the apparatus to a second end of the apparatus. The apparatus also includes a flap folding system for folding the top flaps of the box into folded and horizontal positions as the box is conveyed from a first end of the apparatus to a second end of the apparatus. More specifically, the flap folding system includes a first flap folding member, a second flap folding member and a pair of oppositely disposed side flap folding members. The first flap folding member is configured to fold a fourth top flap of the box. The second flap folding member is configured to fold a second top flap of the box. The pair of oppositely disposed side flap folding members are configured to fold a first and third top flaps of the box so as to abut each other. The apparatus also includes a tape dispensing system. The tape dispensing system is configured to dispense tape across at least a portion of the third and fourth top flaps of the box in order to maintain the third and fourth top flaps in abutment with each other, thereby sealing the box.

The apparatus, according to one example embodiment thereof, also includes a size determination system. The size determination system may employ sensors and a processor, and is configured to determine a size of the box to be sealed. The size determination system may include a width sensor configured to determine a width of the box to be sealed, and size data obtained from the width sensor may be employed to adjust the width of a pair of side conveyors which convey the box through the box sealing apparatus. Advantageously, the width of the pair of the conveyors is adjusted so as to correspond to the width of the box to be sealed. The size determination system may also include a height sensor configured to determine a height of the box to be sealed, and size data obtained from the height sensor may be employed to adjust the height of a carriage to which is connected the tape dispenser and the second end of the side flap folding members. Advantageously, the height of the carriage is adjusted so as to correspond to the height of the box to be sealed.

DETAILED DESCRIPTION OF THE INVENTION

The present invention, in accordance with one example embodiment, relates to an apparatus and method for sealing boxes. The apparatus described below may be employed to seal any side of a box—however, for the purposes of clarity only, the apparatus and method will be described hereinafter as sealing a top of a box which has already had its bottom sealed and which has already been filled with products. However, the present invention, in accordance with various embodiments thereof, may also be employed to seal the bottom of a box, before the box is filled, as will be evident from the discussion below.

Figure 2:
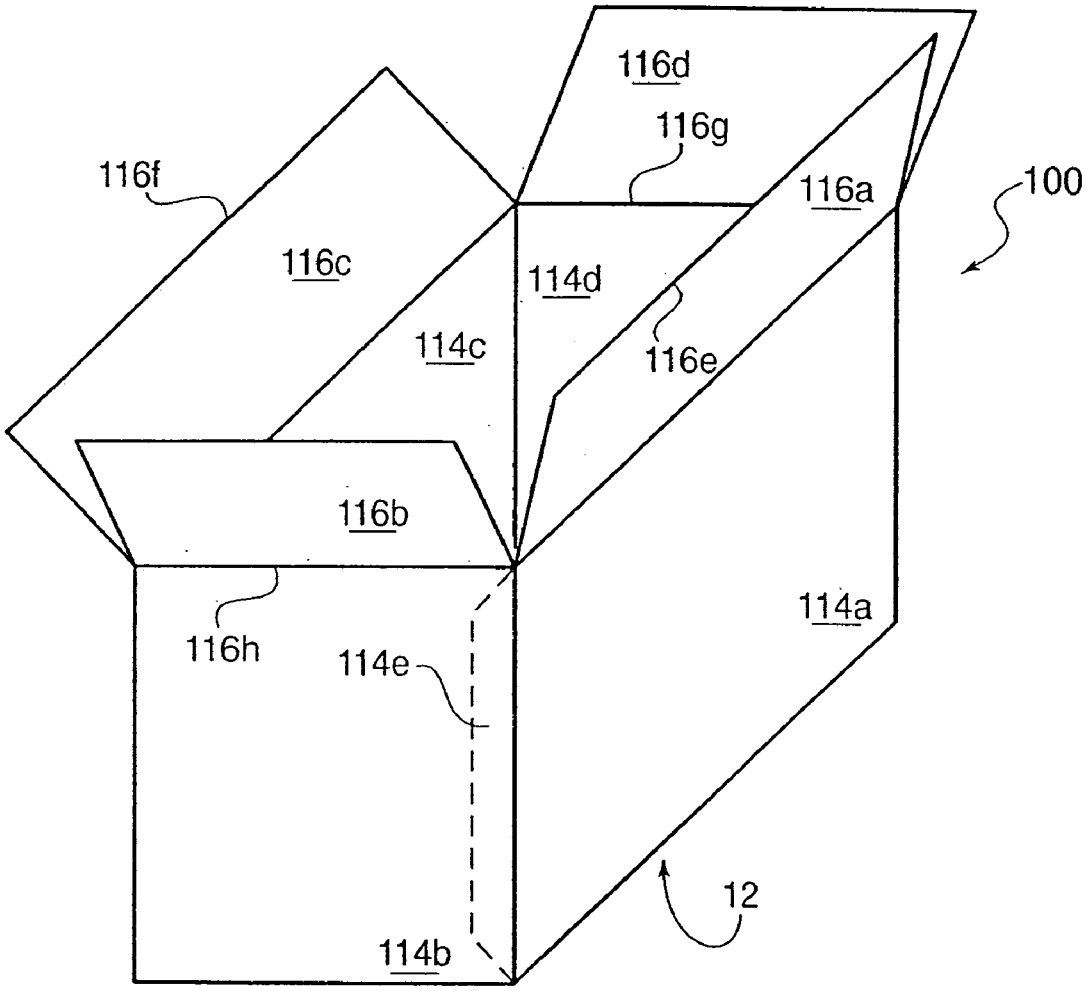
FIG. 2 illustrates a box which may be sealed using the apparatus and method of the present invention, in accordance with one example embodiment thereof.

FIG. 2 illustrates a box 100, which has top flaps 116 that are unsealed, and which may be sealed using the apparatus and method of the present invention, in accordance with one example embodiment thereof. Advantageously, and for the purposes of illustration in the accompanying figures, the box 100 is made of a single sheet of cardboard or similar material which is cut and folded in order to maintain the shape of a box. However, in accordance with alternate embodiments of the present invention, the box 100 may be made of separate sheets of cardboard or other material which are connected by any known means, such as taping, gluing, etc. In addition, for the purposes of illustration in the accompanying figures, the box 100 is shown as being rectangular in shape. However, in accordance with alternate embodiments of the present invention, the box 100 may have a different shape.

As shown in FIG. 2, the box 100 has a first side 114*a*, a second side 114*b*, a third side 114*c* and a fourth side 114*d*, each of which is coupled to and folded perpendicular to its neighboring sides. in addition, the box 100 has a strip 114*e* which extends from fourth side 114*d* and which overlaps and is fastened to the first side 114*a*. A bottom 112 of the box 100, shown in ghost lines, may be formed in any known manner, but is advantageously formed using the apparatus and method of the present invention, as described hereinbelow .

For the purposes of illustration, once the bottom of the box 100 has been fastened, the box 100 can be filled with any conceivable type of product. Once filled, the top flaps of the box 100 can then be sealed by employing the method and apparatus of the present invention, as described below. The top flaps 116 of the box 100 includes first top flap 116*a* having a top edge 116*e*, second top flap 116*b* having a top edge 116*f*, third top flap 116*c*, and fourth top flap 116*d* having a bottom edge 116*g*. When unsealed, the first top flap 116*a*, the second top flap 116*b*, the third top flap 116*c* and the fourth top flap 116*d* of the top 116 of the box 100 are unrestrained and free to move relative to the corresponding sides 114 which they are connected to.

Figure 3:
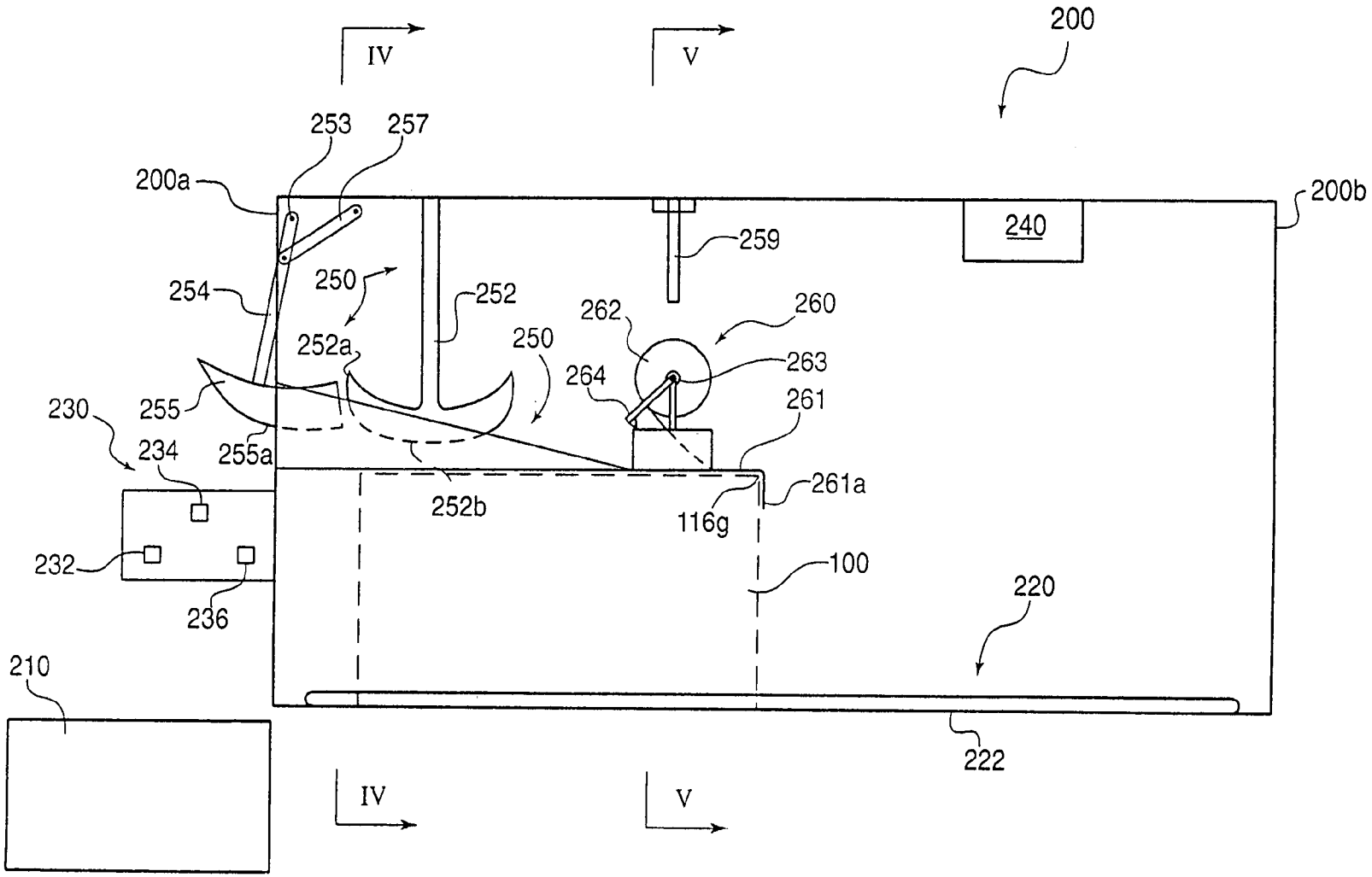
FIG. 3 is a side view which illustrates a box sealing apparatus, in accordance with one example embodiment of the present invention.
Figure 4:
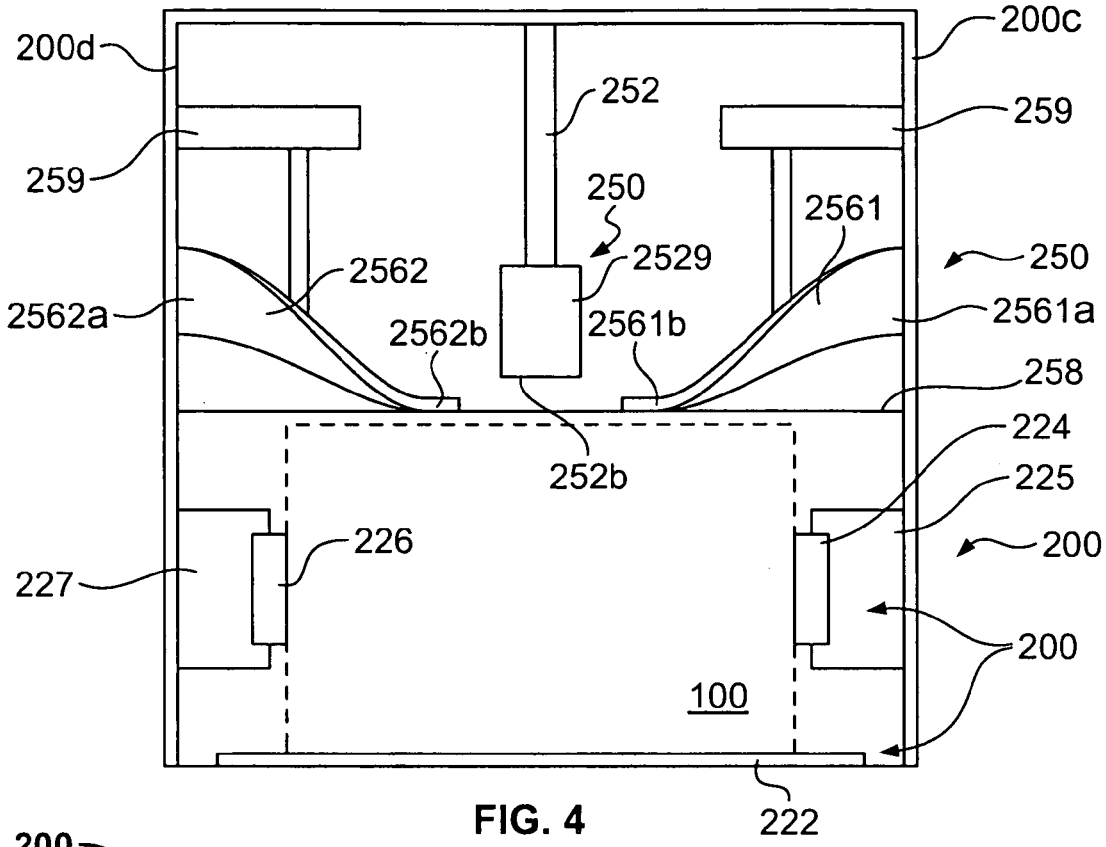
FIG. 4 is a front cross-sectional view of the box sealing apparatus shown in FIG. 3, taken along the line 4—4.
Figure 5:
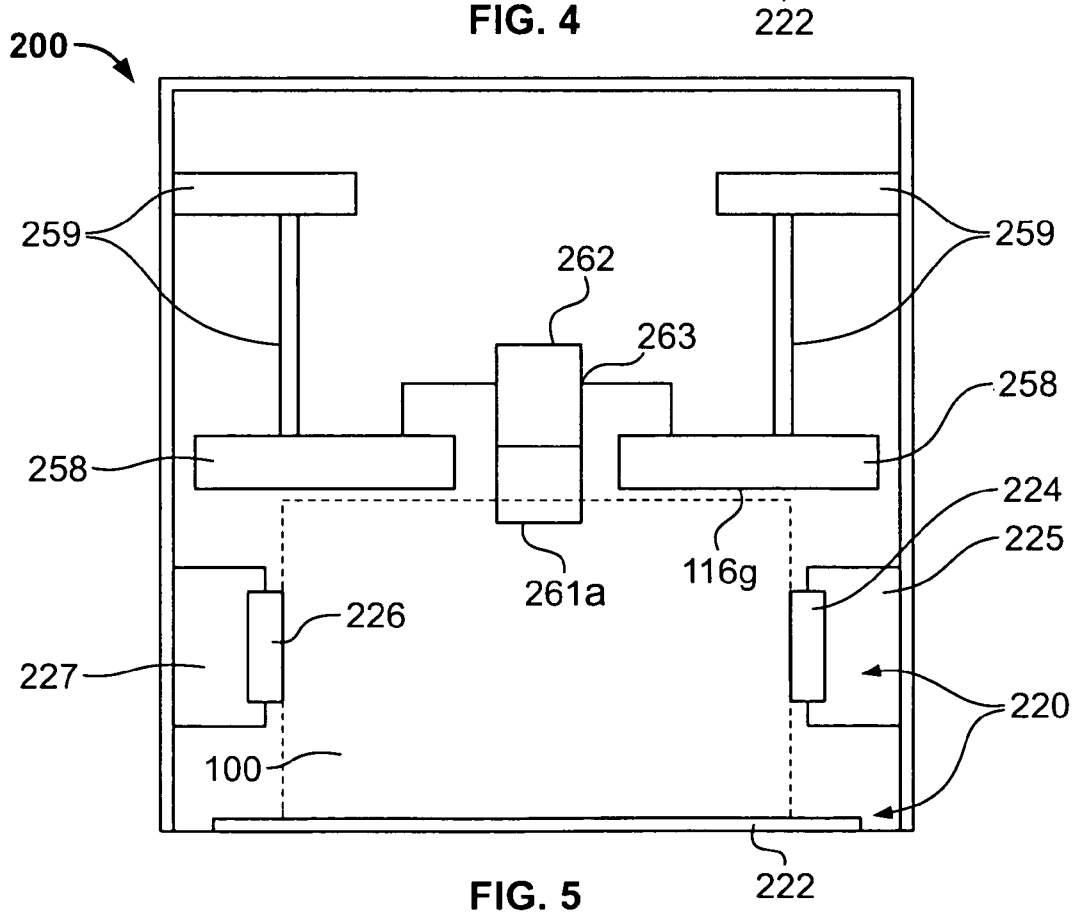
FIG. 5 is a front cross-sectional view of the box sealing apparatus shown in FIG. 3, taken along the line 5—5.

FIGS. 3–5 illustrate a box sealing apparatus 200, in accordance with one example embodiment of the present invention, which may be employed to seal, by way of example, a top of a box which has already had its bottom sealed. For the purposes of example, the box sealing apparatus 200 will be described in connection with the box 100 shown in FIG. 2. More specifically, FIG. 3 is a side view which illustrates the box sealing apparatus 200, in accordance with one example embodiment of the present invention. FIG. 4 is a front cross-sectional view of the box sealing apparatus shown in FIG. 3, taken along the line 4—4. FIG. 5 is a front cross-sectional view of the box sealing apparatus shown in FIG. 3, taken along the line 5—5. In accordance with one example embodiment of the invention, the box sealing apparatus 200 may include a positioning system 210 for positioning a box to be sealed by the box sealing apparatus 200. For instance, the positioning system 210 may include any combination of conveyors, elevators, etc. which positions the box to be sealed at a first end 200*a* of the box sealing apparatus 200.

The box sealing apparatus 200 may also include a size determination system 230 for determining the size of the box to be sealed. Advantageously, the size determination system 230 includes a width sensor 232 for determining the width of the box 100, a height sensor 234 for determining the height of the box 100, and a length sensor 236 for determining the length and/or position of the box 100. The width sensor 232, the height sensor 234 and the length sensor 236 are coupled to a processor 240 which is configured to process the data received from the width sensor 232, the height sensor 234 and the length senor 236, as described more fully in connection with FIGS. 7 and 8.

The box sealing apparatus 200 may also include a conveying system 220 for conveying the box 100 from the first end 200*a* of the box sealing apparatus 200 (at which the box is unsealed) through the box sealing apparatus 200 to a second end 200*b* of the box sealing apparatus 200 (at which the box has been sealed). In accordance with the example embodiment of the invention shown in FIG. 3, the conveying system 220 includes a first conveyor 222 along the bottom of the box sealing device 200, onto which the box to be sealed may be disposed. The first conveyor 222 may be driven by a first motor (not shown). In accordance with the example embodiment of the invention shown in FIG. 3, the conveying system 220 may also include a first side conveyor 224 and a second side conveyor 226 along two opposite sides 200*c* and 200*d* of the box sealing, device 200. The box to be sealed is disposed in between the first side conveyor 224 and the second side conveyor 226, which moves the box from the first end 200*a* of the box sealing apparatus 200 to the second end 200*b* of the box sealing apparatus 200. The first side conveyor 224 and the second side conveyor 226 may be driven by a single motor (not shown) or else may be driven by a separate motors (not shown). In addition, in accordance with an alternate example embodiment of the present invention, a single motor (not shown) employing appropriate gears and connections may be employed to simultaneously drive the first conveyor 222, the first side conveyor 224 and the second side conveyor 226.

According to one example embodiment of the present invention, the first side conveyor 224 and the second side conveyor 226 are adjustable so as to accommodate boxes of various different widths. In this embodiment, the first side conveyor 224 is coupled to a first side conveyor adjustment mechanism 225 which is configured to adjust the first side conveyor 224. Similarly, the second side conveyor 226 is coupled to a second side conveyor adjustment mechanism 227 which is configured to adjust the second side conveyor 226. Advantageously, the first side conveyor adjustment mechanism 225 and the second side conveyor adjustment mechanism 227 are coupled to the processor 240, which processes the data received from the width sensor 232 of the size determination system 230 and which controls the adjustment of the first side conveyor adjustment mechanism 225 and the second side conveyor adjustment mechanism 227 accordingly.

The box sealing apparatus 200 may also include a flap folding system 250 for folding the top flaps of the box to be sealed. In accordance with the example embodiment of the invention shown in FIG. 3, the flap folding system 250 includes a first flap folding member 252. The first flap folding member 252 may be rigidly connected to the box sealing apparatus 200 at a predetermined height (as shown in FIG. 3), or else may advantageously be connected to an adjustable member of the box sealing apparatus 200 such as a carriage 258 (explained in greater detail below), which enables the height of the first flap folding member 252 to be adjustable also. The first flap folding member 252 includes a vertical face 252*a* which curves into a horizontal face 252*b*. Advantageously, the horizontal face 252*b* of the first flap folding member 252 is at a height which is substantially the same as the height of the box to be sealed.

The flap folding system 250 also includes a second flap folding member 254. The second flap folding member 254 includes a hammer 255 pivotably mounted via a pivot 253 to the box sealing apparatus 200. The second flap folding member 254 may be pivotably connected at the pivot 253 at a predetermined height (as shown in FIG. 3), or else may advantageously be connected to an adjustable member of the box sealing apparatus 200 such as a carriage 258 (explained in greater detail below), which enables the height of the second flap folding member 254 to be adjustable also. The hammer 255 is configured to be moved from a first position to a second position by an actuation mechanism 257. Actuation mechanism 257 may include, for instance, a pneumatic or electro mechanical device configured to move the hammer from the first position to the second position, and back again. In the first position, the hammer is maintained above of the top flaps 116 of the box to be sealed. In the second position, the hammer 255 is positioned such that a folding surface 255*a* is at a height which is substantially the same as the height of the box to be sealed. The actuation of the hammer 255 from the first position to the second position is controlled, in accordance with one example embodiment of the invention, by processor 240, which receives an indication from the length sensor 236 that the box is in the appropriate position, and which provides an actuation signal to actuation mechanism 257 to move the hammer.

In accordance with the example embodiment of the invention shown in FIG. 3, the flap folding system 250 also includes a first side flap folding member 2561 and a second side flap folding member 2562. A first end 2561*a* of the first side flap folding member 2561 is coupled at the first end 200*a* of the box sealing apparatus 200 in a vertical arrangement at a height which is greater than the top edge 116*g* of the box 100 but which is less than the top edge 116*e* of the top flap 116*a*. The first side flap folding member 2561 is twisted so that a second end 2561*b* of the first side flap folding member 2561 is coupled to a carriage 258 of the box sealing apparatus 200 in a horizontal arrangement at a height which is substantially the same as the height of the top edge 116*g* of the box 100. Similarly, a first end 2562*a* of the second side flap folding member 2562 is coupled at the first end 200*a* of the box sealing apparatus 200 in a vertical arrangement at a height which is greater than the top edge 116*g* of the box 100 but which is less than the top edge 116*f* of the top flap 116*c*. The second side flap folding member 2562 is rotated so that a second end 2562b of the second side flap folding member 2562 is coupled to the carriage 258 of the box sealing apparatus 200 in a horizontal arrangement at a height which is substantially the same as the height of the top edge 116*g* of the box 100.

According to one example embodiment of the present invention, the carriage 258 to which the second end 2561*b* of the first side flap folding member 2561 and the second end 2562*b* of the second side flap folding member 2562 are connected is adjustable so as to accommodate boxes of various different heights. In this embodiment, the carriage 258 is coupled to a carriage adjustment mechanism 259 which is configured to adjust the carriage 258. Advantageously, the carriage adjustment mechanism 259 is coupled to the processor 240, which processes the data received from the height sensor 234 of the size determination system 230 and which controls the adjustment of the carriage adjustment mechanism 259 accordingly.

The box sealing apparatus 200 may also include a tape dispensing system 260 for dispensing tape onto the box to be sealed. In accordance with the example embodiment of the invention shown in FIG. 3, the tape dispensing system 260 includes a tape reel 262, onto which is wound tape 261 to be dispensed. The tape reel 262 is pivotably mounted via pivot 263 to the box sealing apparatus 200 such that a first end 261 a of tape 261 is initially disposed below the top edge 116*g* of the box 100. The tape dispensing system 260 also includes a tape cutter 264 which cuts the tape 261 after it has been dispensed on the box 100.

Next is described the operation of the box sealing apparatus 200 (in accordance with the example embodiment of the present invention shown in FIGS. 3–5) in order to seal the top flaps 116 of the box 100 shown in FIG. 2. First, the positioning system 210 of the box sealing apparatus 200 positions the fourth side 114*d* of the box 100 at the first end 200*a* of the box sealing apparatus 200. As previously mentioned, the positioning system 210 may employ any combination of conveyors, elevators, etc. in order to position the fourth side 114*d* of the box 100 at the first end 200*a* of the box sealing apparatus 200. Next, the size determination system 230 of the box sealing apparatus 200 determines the size of the box 100. More specifically, the width sensor 232 determines the width of the box 100 and the height sensor 234 determines the height of the box 100. The size data which is determined by the width sensor 232 and the height sensor 234 is transmitted to the processor 240. The processor 240 processes the data received from the width sensor 232 and sends appropriate signals to the first side conveyor adjustment mechanism 225 to adjust the first side conveyor 224 and to the second side conveyor adjustment mechanism 227 to adjust the second side conveyor 226. Advantageously, the first side conveyor 224 and the second side conveyor 226 are adjusted so that the distance between them is substantially the same distance as the width of the box 100.

Once the conveyors of the conveying system 220 are appropriately adjusted, the first conveyor 222, the first side conveyor 224 and the second side conveyor 226 convey the box 100 from the first end 200*a* of the box sealing apparatus 200 into the box sealing apparatus 200 toward the second end 200*b* of the box sealing apparatus 200. Upon entering the box sealing apparatus 200, the vertical face 252*a* of the first flap folding member 252 engages the fourth top flap 116*d* of the box 100. As the box 100 moves through the box sealing apparatus 200, the fourth top flap 116*d* of the box 100 is gradually folded over by its contact with the vertical face 252*a* until the fourth top flap 116*d* eventually contacts the horizontal face 252*b* of the first flap folding member 252. The horizontal face 252*b* of the first flap folding member 252 maintains the top flap 116*d* in the folded position, whereby the top flap 116*d* is substantially perpendicular to the side 114*d*.

Similarly, as the box 100 moves through the box sealing apparatus 200, the hammer 255 of the second flap folding member 254 is caused to pivot between its first position and its second position. Specifically, the hammer 255 of the second flap folding member 254 is maintained in its first position above of the top flaps 116 of the box 100 until the top flap 116*b* has traveled past the length sensor 236. According to one example embodiment of the present invention, the length sensor 236 of the box sealing apparatus 200 provides an indication that the box 100 is in the appropriate position to activate the movement of the hammer 255. Once the box 100 is in this position, the hammer 255 is caused (such as by gravity, pneumatic controls, electro-mechanical controls, etc.) to pivot around the pivot point 253 and contacts the second top flap 116*b* in order to move it into the folded position, whereby the top flap 116*b* is perpendicular to the second side 114*b* and is folded toward the fourth side 114*d*. After the hammer 255 is in the second position, its folding surface 255*a* is in a substantially horizontal orientation at a relative height substantially the same as the horizontal face 252*b* of the first flap folding member 252. The folding surface 255*a* of the hammer 255 maintains the second top flap 116*b* in the perpendicular position until, by the conveyance of the box 100 toward the second end 200*b* of the box sealing apparatus 200, the top flap 116*b* is positioned beneath the horizontal face 252*b* of the first flap folding member 252. Once the second top flap 116*b* is positioned beneath the horizontal face 252*b* of the first flap folding member 252, the horizontal face 252*b* of the first flap folding member 252 maintains the second top flap 116*b* in the perpendicular, folded position.

In addition, when the box 100 enters the first end 200*a* of the box sealing apparatus 200, the first top flap 116*a*, which is initially disposed in a substantially vertical position, engages the first end 2561*a* of the first side flap folding member 2561. Simultaneously, when the box 100 enters the first end 200*a* of the box sealing apparatus 200, the third top flap 116*c*, which is initially disposed in a substantially vertical position, engages the first end 2562*a* of the second side flap folding member 2562. As the box 100 moves through the box sealing apparatus 200, the first top flap 116*a* moves towards the horizontally-disposed second end 2561*b* of the first side flap folding member 2561, thereby gradually being folded over until it is maintained in a horizontal position. Likewise, as the box 100 moves through the box sealing apparatus 200, the third top flap 116*c* moves towards the horizontally-disposed second end 2562*b* of the second side flap folding member 2562, thereby gradually being folded over until it too is maintained in a horizontal position. Thus, all four top flaps 116 of the box 100 are thereby folded over horizontally, such that the second top flap 116*b* and the fourth top flap 116*d* are disposed beneath the first top flap 116*a* and the third top flap 116*c*.

As explained previously, when the box 100 is in this closed position, the edge 116*e* of the first top flap 116*a* advantageously abuts the edge 16*f* of the third top flap 116*c*. Thus, once the first top flap 116*a* and the third top flap 116*c* of the box 100 are disposed in the horizontal, folded positions, the advancement of the box 100 through the box sealing apparatus 200 causes the fourth side 114*d* of the box 100 to contact the tape dispensing system 260. As previously explained, the tape dispensing system 260 is configured so as to initially maintain a first end 261*a* of tape 261 at a predetermined distance (e.g., preferably several inches) below the top edge 116*g* of the box 100, thereby affixing the first end 261*a* of the tape 261 to the outside surface of the fourth side 114*d* of the box 100. The tape dispensing system 260 is then lifted by the box 100 so that the tape 261 is disposed on the top of the box 100. As the box 100 is moved through the box sealing apparatus 200, the tape 261 is unwound from the tape reel 262, and is pressed into adhesive contact with the first top flap 116*a* and the third top flap 116*c* of the box 100. Advantageously, the tape 261 is pressed into adhesive contact with the first top flap 116*a* and the third top flap 116*c* of the box 100 such that a first half of the width of the tape 261 is pressed into adhesive contact with the first top flap 116*a* along edge 116*e*, and a second half of the width of the tape 261 is pressed into adhesive contact with the third top flap 116*c* along edge 116*f*. When the entire lengths of edges 116*e* and 116*f* have been taped, the tape dispensing system 260 is lowered back to its initial position, thereby affixing a predetermined length of the tape 261 to the outside surface of the second side 114*b* of the box 100. The tape is cut at this predetermined length by the tape cutter 264, and the tape dispensing system 260 is thereby returned to its original position awaiting the next box to be passed through the box sealing apparatus 200.

Once the box 100 has been taped along the fourth side 114*d*, the first top flap 116*a*, the third top flap 114*c* and the second side 114*b*, the box 100 is sealed and is thereby further conveyed by the conveying system 220 out of the second end 200*b* of the box sealing apparatus 200. Once the sealed box 100 has exited the box sealing apparatus 200, the box 100 may be moved to another location for further processing, loaded onto trucks for transport, etc.

Figure 6:
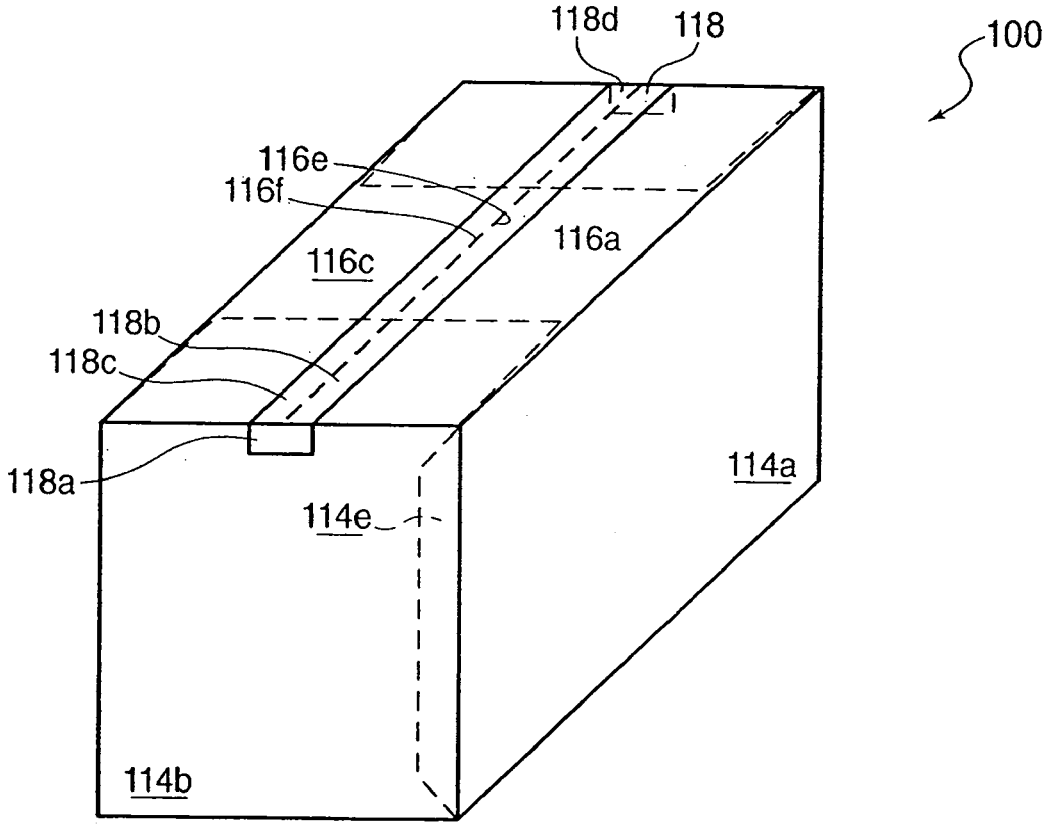
FIG. 6 illustrates the box shown in FIG. 2 which has been sealed in accordance with the box sealing apparatus shown in FIGS. 3–5.

FIG. 6 shows a box 100 which has been sealed in accordance with the example embodiments of the present invention shown in FIGS. 3–5. As shown in FIG. 6, the second top flap 116*b* and the fourth top flap 116*d* and folded toward each other until they are positioned perpendicular to the sides 114 of the box 100. In addition, the first top flap 116*a* and the third top flap 116*c* are likewise folded toward each other until they also are positioned perpendicular to the sides 114 and such that the edge 116*e* of the first top flap 116*a* abuts the edge 116*f* of the third top flap 116*c*. In order to maintain the edge 116*e* of the first top flap 116*a* in abutment with the edge 116*f* of the third top flap 116*c* and thereby seal the box 100, a strip of tape 118 is disposed thereon. Specifically, a first region 118*a* of the strip of tape 118 is maintained in adhesive contact with the second side 114*b* of the box 100. A second region 118*b* of the strip of tape 118 is maintained in adhesive contact with the first top flap 116*a* of the box 100 along edge 116*e*. A third region 118*c* of the strip of tape 118 is maintained in adhesive contact with the third top flap 116*c* of the box 100 along edge 116*f*. Finally, a fourth region 118*d* of the strip of tape 118 is maintained in adhesive contact with the fourth side 114*d* of the box 100.

Figure 7:
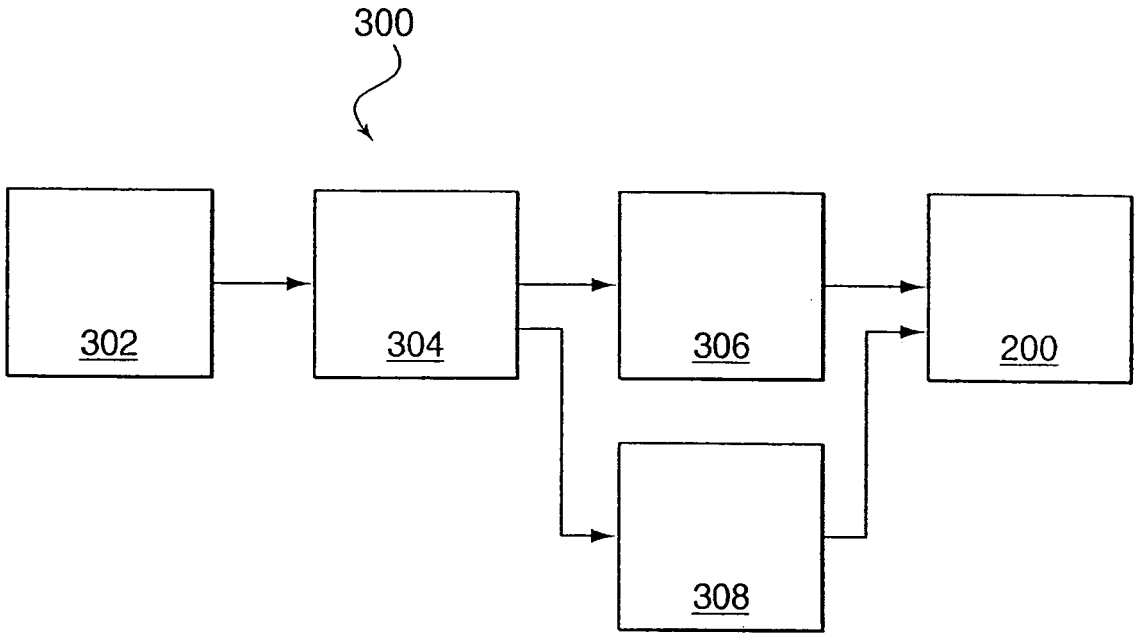
FIG. 7 illustrates schematically a control system for controlling the adjustment and operation of the box sealing apparatus, in accordance with one example embodiment of the present invention.

FIG. 7 illustrates schematically a control system 300 for controlling the adjustment and operation of the box sealing apparatus 200, in accordance with one example embodiment of the present invention. The control system 300 includes a sensor system 302. The sensor system 302 is made up of at least one sensor for determining the size and/or position of the box 100 to be sealed. In the example embodiment illustrated in FIGS. 3 through 5, the sensor system 302 includes the width sensor 232, the height sensor 234 and the length sensor 236, although it is recognized that the sensor system 302 may include any type or combination of sensors.

As shown in FIG. 7, according to one example embodiment of the present invention, the sensor system 302 is coupled to a processor 304, such as the processor 240 illustrated in FIGS. 3 through 5. Advantageously, the sensor system 302 is configured to provide data to processor 304, such as the size and/or position data which is determined by the sensor system 302. For instance, according to one example embodiment, the height sensor 234 may comprise light sensors disposed at several different heights, such that a box to be sealed, when positioned between opposing sensors, breaks a light beam of each sensor except those sensors which are disposed above the top edge of the box. The data which may be transmitted between the sensor system 302 and the processor 304, in this case, may be a signal from those sensors which have had its light beam broken by the box, thereby indicating the height of the box. The processor 304 is advantageously configured to process the data received from the sensor system 302. According to one example embodiment of the present invention, the processor 304 is a collection of relay switches or the like which are configured to open and/or close in a predetermined manner. Alternatively, in accordance with another example embodiment of the present invention, the processor 304 is a computer having software or hardware which is configured to receive and process the data from the sensor system 302. The processor 304 may be integral with the box sealing apparatus 200, as is shown in FIGS. 3 through 5, or else the processor may be disposed separately from the box seating apparatus 200.

The processor 304 is coupled to the adjustment means 306, which in turn is coupled to the adjustable components of the box sealing apparatus 200. The adjustment means 306 is made up of at least one adjustment mechanism for adjusting components of the box sealing apparatus 200. In the example embodiment illustrated in FIGS. 3 through 5, and as previously discussed above, the adjustment means 306 may include the first side conveyor adjustment mechanism 225, the second side conveyor adjustment mechanism 227, an adjustment mechanism for varying the height of the carriage 258, etc. The components to be adjusted by the adjustment means 306 may include, for instance, the first side conveyor 224 (which is adjusted by the first side conveyor adjustment mechanism 225), the second side conveyor (which is adjusted by the second side conveyor adjustment mechanism 227), the carriage 258, etc.

The processor 304 is also coupled, in accordance with one example embodiment of the present invention, to the actuation means 308, which in turn is coupled to the actuatable components of the box sealing apparatus 200. The actuation means 308 is made up of at least one actuation mechanism for actuating components of the box sealing apparatus 200. In the example embodiment illustrated in FIGS. 3 through 5, and as previously discussed above, the actuation means 308 may include, for instance, the hammer actuation mechanism 257. The components of the box sealing apparatus 200 to be actuated by the actuation means 308 may include, for instance, the hammer 255 of the second flap folding member 254.

Generally, the processor 304 is configured to process the data received from the sensor system 302 and to generate appropriate instructions or signals to adjustment means 306 and/or to actuation means 308. It is recognized, however, that the box sealing apparatus 200 discussed herein may also have a myriad of additional features which are controlled by the processor 304, whereby the processor 304 receives data from the box sealing apparatus 200 and transmits corresponding signals back to the apparatus in response thereto or transmits the corresponding signals to a separate system for further processing (e.g., in accordance with another example embodiment of the present invention, the processor 306 may be configured to track inventory such as by counting the number and size of the boxes which are sealed thereby). For instance, in accordance with one example embodiment of the present invention, the processor 306 may be configured to switch between manual and automatic operations, in accordance with the selection of one of these modes by a user via a mode selection switch (not shown). Furthermore, in accordance with another example embodiment of the present invention, the processor 306 may be configured to switch between forward and reverse directions of operation, in accordance with the selection of one of these directions by a user via a direction selection switch (not shown). Also, in accordance with still another example embodiment of the present invention, the processor 306 may be configured to switch between different speeds of operation, in accordance with the selection of a particular speed by a user via a speed selection switch (not shown). As previously mentioned, the processor 306 may include a computer programmed to operate the box sealing apparatus in accordance with the switch settings selected by a user, or else, the processor 306 may include a combination of relay switches and solenoid valves (such as are illustrated in FIG. 8) that are configured for this same purpose, or else may include aspects of both configurations to accomplish the same purpose.

Figure 8:
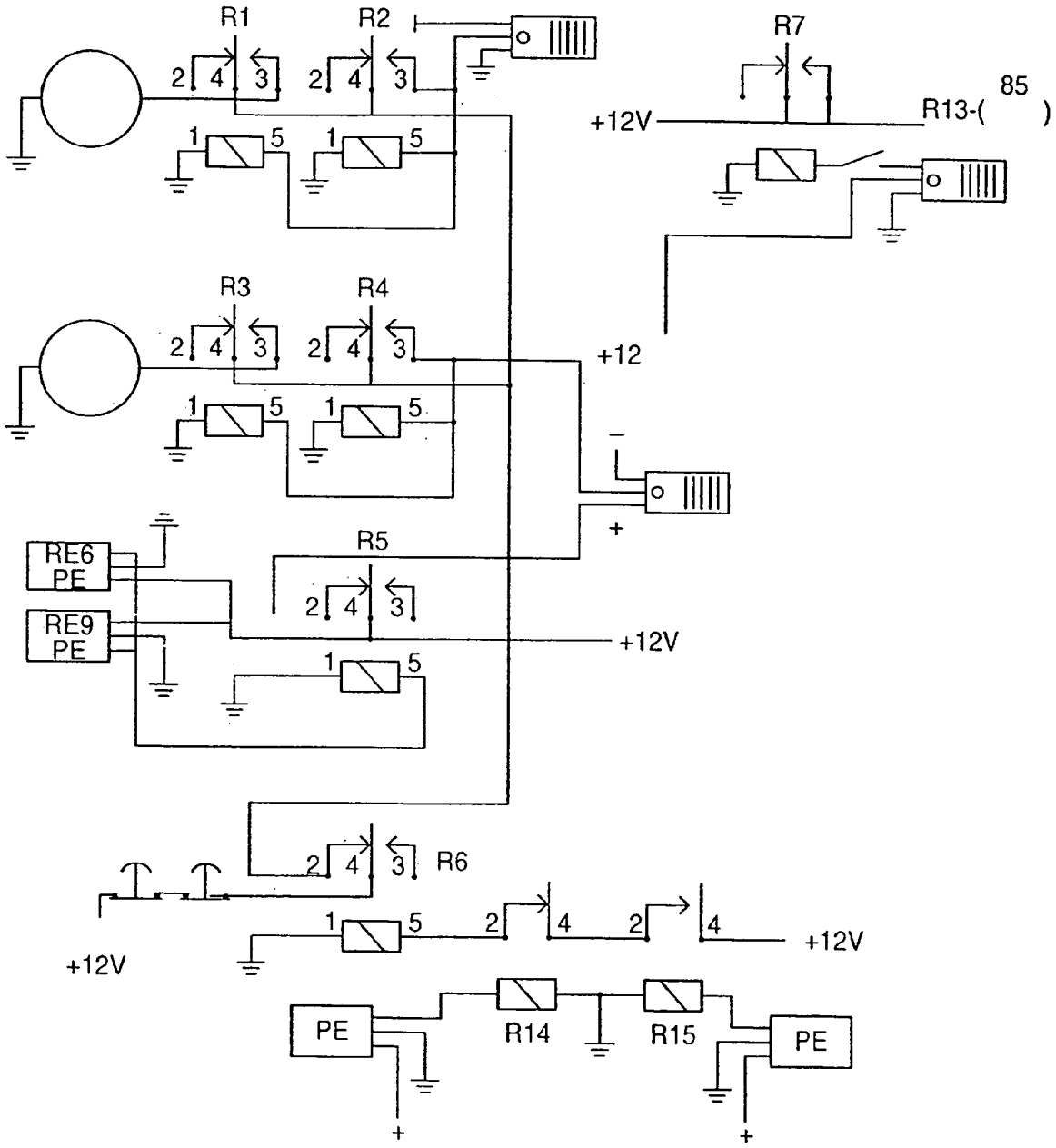
FIG. 8 illustrates an exemplary embodiment of a control system for operating the box sealing apparatus of the present invention.

Generally, FIG. 8 illustrates, according to one example embodiment, a combination of relay switches, solenoid valves, etc. that are configured to operate the box sealing apparatus 200 in accordance with and in response to data received from the sensor systems of the box sealing apparatus 200 and from the switch settings selected by a user. Briefly, FIG. 8 illustrates several photo-eye sensors. A first photo-eye sensor identified as "Jumbo Box P/E" may be positioned at a high elevation relative to the box sealing apparatus 200 and may provide a signal when a large box breaks its light beam to its corresponding relay switches and a first solenoid valve, thereby positioning the components of the box sealing apparatus 200 to accommodate a large box. A second photo-eye sensor identified as "Small Box P/E" may be positioned at a low elevation relative to the box sealing apparatus 200 and may provide a signal when a small box breaks its light beam to its corresponding relay switches and a second solenoid valve, thereby positioning the components of the box sealing apparatus 200 to accommodate a small box. Otherwise, the relay switches are configured to position the components of the box sealing apparatus so as to accommodate a regular sized box. Other relay switches are also illustrated for the purposes of, for instance, switching between automatic and manual operations and for providing an indication when a box clears the tape dispensing device of the box sealing apparatus 200. Of course, it is recognized that this is merely one configuration that may be employed for these purposes, and that the present invention contemplates any configuration which may facilitate the operation of the box sealing apparatus as previously described herein.

The present invention, according to the example embodiments described herein, may help alleviate some of the problems which are experienced by the conventional methods of sealing boxes. For instance, and as previously mentioned, the conventionally employed method of stapling boxes closed is labor-intensive in that the staples must be individually applied. By contrast, the box sealing apparatus 200 of the present invention, according to the example embodiment described herein, eliminates the need to individually apply each staple to the box because it automates the process of sealing the boxes.

Figure 1:
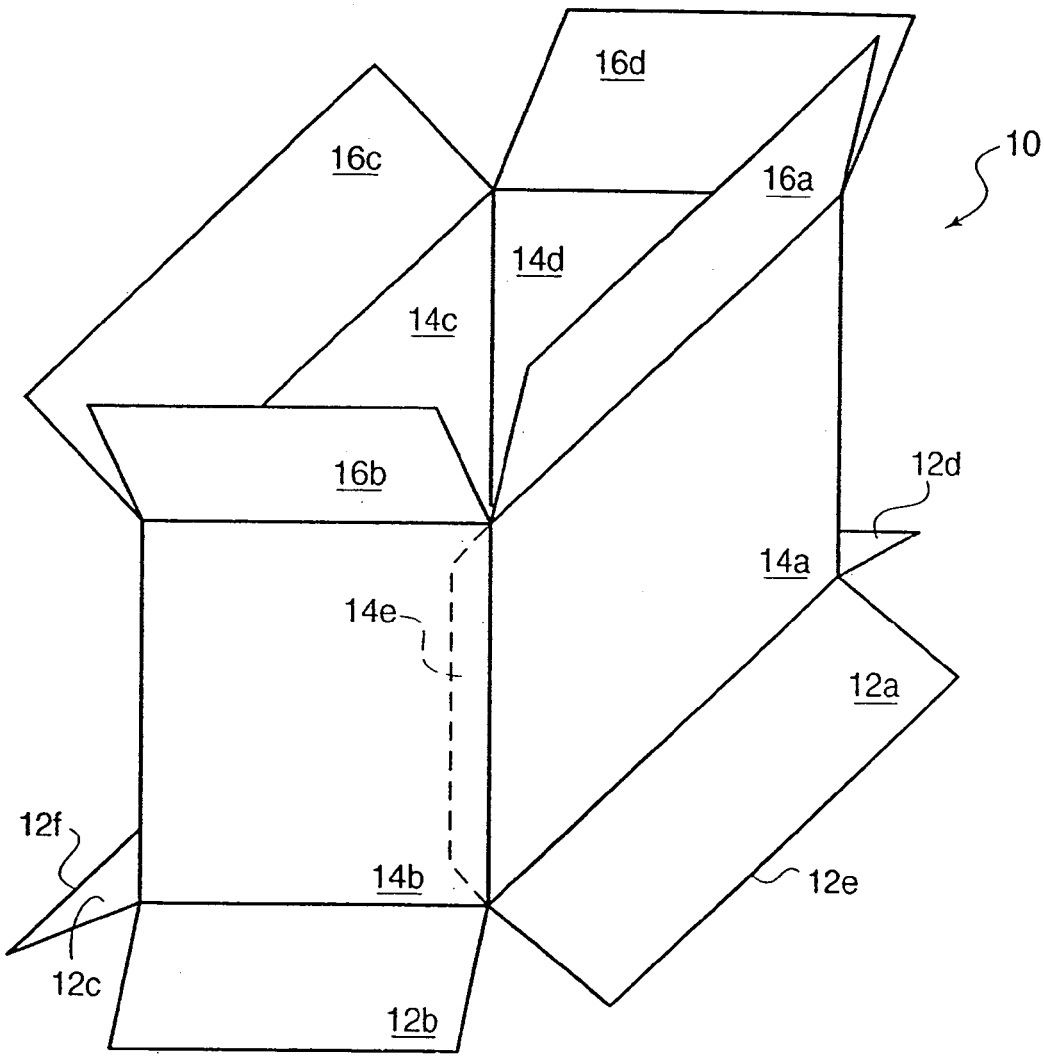
FIG. 1 is a perspective view of a box made from a single sheet of cardboard or the like, as is well-known in the prior art.

In addition, and as previously mentioned, the conventionally employed method of stapling boxes closed is ineffective in that the boxes are inadequately sealed. More specifically, referring to the box 10 illustrated in FIG. 1, the conventionally employed method of stapling boxes closed causes spaces to be left (e.g., along the edges 16*e* and 16*f* in between the staples) through which products may leak out of or escape from the box 10, or through which other substances may leak into or enter the box 10. By contrast, the box sealing apparatus 200 of the present invention, according to the example embodiment described herein, more effectively seals the box 200. As shown in FIG. 6, the tape 118 provides a complete seal of the edge 116*e* of the first top flap 116*a* to the edge 116*f* of the third top flap 116*c*. In addition, the tape 118 seals, for the width of the tape 118, the top flaps 116 of the box 100 to both the second side 114*b* and the fourth side 114*d* of the box 100. Thus, the box 100 is less likely to have products stored within leak out of or escape from the box 100, and is less likely to have other substances leak into or enter the box 10.

Furthermore, and as previously mentioned, the conventionally employed method of stapling boxes closed is unsafe, in that the prongs of the staples may injure persons that are applying the staples to seal the box. In addition, the prongs of the staples may injure persons that are opening the box. By contrast, the box sealing apparatus 200 of the present invention, according to the example embodiments described herein, is more safe, in that no staples, and thus no prongs, are employed to seal the box. Instead, the present invention, according to the example embodiments described herein, employs tape which has no sharp edges or points that can injure a person that handles the box.

Finally, and as previously mentioned, the conventionally employed method of stapling boxes closed is unsanitary. For instance, if the product or products in the box is food which is unwrapped, the staples that are employed may inadvertently puncture the products inside the box. In addition, if the products in the box is food wrapped in individual packaging, the puncturing of the packaging may cause the food to spoil. Also, the staples may oxidize or rust and thereby contaminate the products in the box. Any of these occurrences may create health risks to consumers and may cause economic loss to the producer of the food. By contrast, the box sealing apparatus 200 of the present invention, according to the example embodiments described herein, is more sanitary, in that no staples are present to puncture either products or packaging within the box or to contaminate the contents of the box with rust or oxidation. Instead, the present invention, according to the example embodiments described herein, employs tape 261 on the outside of the box 200 only, and which does not penetrate into the box 200.

Thus, the several aforementioned objects and advantages of the present invention are most effectively attained Those skilled in the art will appreciate that numerous modifications of the exemplary embodiment described hereinabove may be made without departing from the spirit and scope of the invention. Although a single exemplary embodiment of the present invention has been described and disclosed in detail herein, it should be understood that this invention is in no sense limited thereby and that its scope is to be determined by that of the appended claims.

What is claimed is:

1. A method for sealing a box having four top flaps initially disposed in an open position, said method comprising the steps of:

determining a width of the box via a width sensor disposed at a first end of a box sealing apparatus;

adjusting a pair of oppositely-disposed side conveyors disposed in the box sealing apparatus based on the width of the box determined by the width sensor;

determining a height of the box via a height sensor disposed at the first end of the box sealing apparatus;

adjusting a vertical position of a tape dispensing mechanism in the box sealing apparatus based on the height of the box determined by the height sensor;

conveying the box from the first end of the box sealing apparatus to a second end of the apparatus using the pair of oppositely-disposed side conveyors;

folding a fourth top flap of the box into a folded and horizontal position with a first flap folding member;

folding a second top flap of the box into a folded and horizontal position with a second flap folding member;

folding, via a pair of oppositely disposed side flap folding members, first and third top flaps of the box into a folded and horizontal position so as to abut each other, each of the pair of oppositely disposed side flap folding members being twisted to have a vertical first end and a horizontal second end;

adjusting a vertical position of the horizontal second ends of the oppositely disposed flap folding members based on the height of the box without adjusting a vertical position of the vertical first ends; and dispensing tape from the tape dispensing mechanism across at least a portion of the first and third top flaps of the box in order to maintain the first and third top flaps in abutment with each other, thereby sealing the box.

2. The method according to claim 1, wherein the step of folding the fourth top flap of the box comprises contacting the fourth top flap with a stationary surface cite first flap folding member configured to fold the fourth flap as the box is conveyed from the first end of the apparatus to the second end of the apparatus.

3. The method according to claim 1, wherein the second flap folding member is a hammer configured to be moved by a hammer actuation mechanism, and wherein the method further comprises the step of moving the hammer round a pivot from a first position to a second position by a hammer actuation mechanism wherein, in the second position, the second flap folding member maintains the second top flap in the folded position as the box is conveyed from the first end of the apparatus to the second end of the apparatus.

4. The method according to claim 1, wherein the conveying step includes conveying the box with a bottom conveyor.

5. The method according to claim 1, wherein the pair of oppositely-disposed side conveyors are automatically adjusted with a pair of side conveyor adjustment mechanisms.

6. The method according to claim 1, wherein the method further comprises the steps of: receiving at a processor size data from the width sensor; adjusting the side conveyors with side conveyor adjustment mechanisms in accordance with the size data from the width sensor.

7. The method according to claim 1, wherein the apparatus further comprises a carriage.

8. The method according to claim 7, further comprising the step of vertically adjusting the carriage via a carriage adjustment mechanism.

9. The method according to claim 8, wherein the box sealing apparatus further comprises a processor, and wherein the method further comprises the steps of receiving at the processor size data from the height sensor; adjusting the height of the carriage with a carriage adjustment mechanism in accordance with the size data from the height sensor.

10. The method according to claim 9, wherein the tape dispensing system is connected to the carriage.

11. The method according to claim 10, wherein the adjusting step includes adjusting the vertical position of the carriage with the carriage adjustment mechanisms in order to dispose the tape dispensing mechanism at a height corresponding to the height of the box.

12. The method according to claim 9, wherein the first ends of the pair of oppositely disposed side flap folding members are coupled to the first end of the box sealing apparatus, and wherein the second ends of the pair of oppositely disposed side flap folding members are coupled to the carriage.

13. The method according to claim 12, wherein the second end of the side flap folding members are disposed at a height corresponding to the height of the box when the vertical position of the carriage is adjusted with the carriage adjustment mechanism.

14. The method according to claim 1, further comprising: determining a length of the box via a length sensor.

15. The method according to claim 14, wherein the box sealing apparatus further comprises a processor, and wherein the method further comprises the steps of: receiving at the processor size data from the length sensor; actuating the second flap folding member in accordance with the size data from the length sensor.

16. The method according to claim 1, wherein the box has at least a first side and a second side at opposite ends of the box, and wherein the step of dispensing tape includes the step of dispensing tape so as to seal the top flaps of the box to the first side and the second side of the box.

17. A method for sealing a box having four top flaps initially disposed in an open position utilizing a box sealing apparatus, said method comprising the steps of:

determining a width of the box utilizing a width sensor disposed at a first end of the box sealing apparatus;

adjusting a pair of oppositely-disposed side conveyors disposed in the box sealing apparatus based on the width of the box determined by the width sensor;

determining a height of the box utilizing a height sensor disposed at the first end of the box sealing apparatus;

adjusting a vertical position of a carriage in the box sealing apparatus based on the height of the box determined by the height sensor, the carriage attached to a tape dispensing mechanism and a pair of oppositely disposed side flap folding members;

conveying the box from the first end of the box sealing apparatus to a second end of the apparatus utilizing the pair of oppositely-disposed side conveyors;

folding a fourth top flap of the box into a folded and horizontal position with a first flap folding member;

folding a second top flap of the box into a folded and horizontal position with a second flap folding member;

folding the first and third top flaps of the box into a folded sad horizontal position so as to abut each other with the pair of oppositely-disposed side flap folding members, each of the pair of oppositely disposed side flap folding members being twisted to have a vertical first end and a horizontal second end;

adjusting a vertical position of the horizontal second ends of the oppositely disposed flap folding members based on the height of the box without adjusting a vertical position of the vertical first ends; and dispensing tape from the tape dispensing mechanism across at least a portion of the first and third top flaps of the box in order to maintain the first and third top flaps in abutment with each other.

18. The method according to claim 17, wherein the step of folding the fourth top flap of the box comprises contacting the fourth top flap with a stationary surface of the first flap folding member configured to fold the fourth flap as the box is conveyed from the first end of the apparatus to the second end of the apparatus.

19. The method according to claim 17, wherein the second flap folding member is a hammer configured to be moved by a hammer actuation mechanism, and wherein the method further comprises the step of moving the hammer around a pivot from a first position to a second position by a hammer actuation mechanism wherein, in the second position, the second flap folding member maintains the second top flap in the folded position as the box is conveyed from the first end of the apparatus to the second end of the apparatus.

20. The method according to claim 17, wherein the conveying step includes conveying the box with a bottom conveyor.

21. The method according to claim 17, wherein the pair of oppositely-disposed side conveyor is automatically adjusted with a pair of side conveyor adjustment mechanisms.

22. The method according to claim 21, wherein the method further comprises the steps of:

receiving at a processor size data from the width sensor; and adjusting the side conveyors with side conveyor adjustment mechanisms in accordance with the size data from the width sensor.

23. The method according to claim 17, wherein the box sealing apparatus further comprises a processor, and wherein the method further comprises the steps of:

receiving at the processor size data from the height sensor; and adjusting the height of the carriage with a carriage adjustment mechanism in accordance with the size data from the height sensor.

24. The method according to claim 23, wherein the vertical position of the carriage is adjusted with the carriage adjustment mechanisms to dispose the tape dispensing mechanism at a height corresponding to the height of the box.

25. The method according to claim 23, wherein the first ends of the pair of oppositely disposed side flap folding members are coupled to the first end of the box sealing apparatus, and wherein the second cads of the pair of oppositely disposed side flap folding members are coupled to the carriage.

26. The method according to claim 25, wherein the second end of each of the pair of oppositely-disposed side flap folding members are disposed at a height corresponding to the height of the box when the vertical position of the carriage is adjusted with the carriage adjustment mechanism.

27. The method according to claim 17, further comprising: determining a length of the box utilizing a length sensor.

28. The method according to claim 27, wherein the box sealing apparatus further comprises a processor, and wherein the method further comprises the steps of:

receiving at the processor size data from the length sensor; and actuating the second flap folding member in accordance with the size data from the length sensor.

29. The method according to claim 27, wherein the box has at least a first side and a second side at opposite ends of the box, and wherein the step of dispensing tape includes the step of dispensing tape so as to seal the top flaps of the box to the first side and the second side of the box.

30. A method for sealing a box having four top flaps initially disposed in an open position utilizing a box sealing apparatus, said method comprising the steps of:

determining a width of the box utilizing a width sensor disposed at a first end of the box sealing apparatus;

adjusting a pair of oppositely-disposed side conveyors disposed in the box sealing apparatus based on the width of the box determined byte width sensor;

determining a height of the box utilizing a height sensor disposed at the first end of the box sealing apparatus;

adjusting a vertical position of a carriage in the box sealing apparatus based ante height of the box determined by the height sensor, the carriage attached to a tape dispensing mechanism and a pair of oppositely disposed side flap folding members;

determining a position of the box relative to the first end of the box sealing apparatus utilizing a length sensor disposed at the first end of the box sealing apparatus;

conveying the box from the first end of the box sealing apparatus to a second end of the apparatus utilizing the pair of oppositely-disposed side conveyors;

folding a fourth top flap of the box into a folded and horizontal position with a first flap folding member;

folding a second top flap of the box into a folding and horizontal position with a second flap folding member, wherein the second flap folding member is actuated based on the position of the box determined by the length sensor;

folding the first and third top flaps of the box into a folded and horizontal position so as to abut each other with the pair of oppositely-disposed side flap folding members, each of the pair of oppositely disposed side flap folding members being twisted to have a vertical first end and a horizontal second end;

adjusting a vertical position of the horizontal second ends of the oppositely disposed flap folding members based on the height of the box without adjusting a vertical position of the vertical first ends; and dispensing tape from the tape dispensing mechanism across at least a portion of the first and third top flaps of the box in order to maintain the first and third top flaps in abutment with each other.

* * * * *